US005304968A

United States Patent [19]

Ohtonen et al.

[11] Patent Number: 5,304,968

[45] Date of Patent: Apr. 19, 1994

[54] TEMPERATURE COMPENSATED RESONATOR

[75] Inventors: Jorma Ohtonen, Oulu; Kimmo Ervasti, Oulunsalo, both of Finland

[73] Assignee: LK-Products OY, Kempele, Finland

[21] Appl. No.: 971,530

[22] Filed: Oct. 28, 1992

[30] Foreign Application Priority Data

Oct. 31, 1991 [FI] Finland ..... 915156

[51] Int. Cl.[5] ..... H01P 1/30; H01P 7/04

[52] U.S. Cl. ..... 333/222; 333/223; 333/234

[58] Field of Search ..... 333/202, 206, 207, 222–226, 333/229, 234, 235

[56] References Cited

U.S. PATENT DOCUMENTS

| | | | |
|---|---|---|---|
| 2,205,851 | 6/1940 | Hansell | 333/234 |
| 3,733,567 | 5/1973 | Johnson | 333/226 X |
| 3,740,677 | 6/1973 | Kommrusch | 333/234 |
| 3,873,949 | 3/1975 | Dorsi et al. | 333/229 |
| 3,876,963 | 4/1975 | Graham | 333/222 X |
| 4,057,772 | 11/1977 | Basil, Jr. et al. | 333/234 X |
| 4,156,860 | 5/1979 | Atia et al. | 333/229 |
| 4,423,398 | 12/1983 | Jachowski et al. | 333/229 |
| 5,032,807 | 7/1991 | Petrovic | 333/219 X |

FOREIGN PATENT DOCUMENTS

| | | | |
|---|---|---|---|
| 0211455 | 2/1987 | European Pat. Off. . | |
| 0150971 | 9/1981 | Fed. Rep. of Germany | 333/223 |
| 896010 | 2/1945 | France . | |
| 1162703 | 9/1958 | France . | |
| WO87/03745 | 6/1987 | PCT Int'l Appl. . | |

OTHER PUBLICATIONS

Patent Abstracts of Japan vol. 14, No. 455 (E-985), JP2182002, Sep. 1990.

*Primary Examiner*—Seungsook Ham
*Attorney, Agent, or Firm*—Perman & Green

[57] ABSTRACT

The present invention relates specifically to the temperature compensation of a resonator in which a rod or a conductor wound in the form of a cylindrical coil serving as an inner conductor is enclosed within a metal cover and in which the open end of the rod or the coil is spaced a given distance from the cover, thus forming a loading capacitance. A change in the resonant frequency caused by thermal expansion can be compensated for in that at the open end of the inner conductor within the housing there is provided a compensation plate (5), the center part (12) of which is spaced at a distance (a) from the top surface (4) of the housing and preferably in parallel therewith and which has at least at two opposite edge parts (8, 9) been attached to the top surface (4). The thermal coefficient of expansion of the compensation plate (5) is less than the coefficient of thermal expansion of the top surface (4), whereby the center part of the compensation plate (5) together, in response to a rise in temperature of the resonator, is urged towards the top surface (4), thus reducing the loading capacitance.

7 Claims, 1 Drawing Sheet

TEMPERATURE COMPENSATED RESONATOR

The present invention relates to temperature compensation of a resonator in which a compensation plate is positioned between the open end of the resonator inner conductor and the top surface of the resonator in order to compensate for changes in resonator frequency due to changes in resonator temperature.

BACKGROUND OF THE INVENTION

A coaxial resonator of the above type typically consists of a copper resonator rod and an aluminum housing therearound, one wall thereof being at a given space from the tip of the rod, whereby the capacitance between the rod tip and the wall forms a capacitative loading for the resonator. The other end of the rod has been short-circuited with the other, i.e. opposite conducting wall of the housing. The helix resonator differs from the coaxial resonator in principle only in that the inner conductor, i.e. the rod, has been wound in the form of a helical coil, in order to have smaller dimensions.

The coaxial and helical resonators are encumbered with a basic drawback, viz. of how to provide a sufficient thermal stability. In the operational environments, where great temperature variations may be expected, great center frequency drift might occur owing to changes in the structural dimensions due to thermal expansion, and there through, also in the electrical properties. Secondly, when the resonator is used in power applications, the resonator rod becomes strongly heated, particularly at the open end where the field strength is greatest. Said heating of the rod lengthens it and thus shortens the space between the tip of the rod and the wall of the housing. Typically, together with a temperature rise, the resonant frequency decreases; respectively, a drop in the temperature increases the resonant frequency.

In order to compensate for changes in the center frequency caused by temperature variation, a plurality of methods have been used. The methods are mainly based on the idea that since the oscillator circuit of the resonator consists of loading capacitance and inductance of the rod connected in parallel, the capacitance is adapted to be variable in the manner that it as completely as possible compensates for a change of the inductance. This is understandable because it is easier to affect capacitance than inductance. Therefore, the methods include endeavours to reduce loading capacitance according to temperature rise.

One of the most conventional ways is to arrange the distance between the end of the resonator rod and the top surface of the cover, to be appropriate, whereby, as the temperature changes, the spacing between the resonator rod and the top surface changes so that the resonant frequency remains as much unchanged as possible. In practice the spacing between the end of the resonator rod and the top surface of the cover has to be made very small, whereby a drawback is first that when said spacing is very small, the Q value of the resonator is decreased because the capacitance between the end of the rod and the top surface, i.e. the loading of the resonator grows. Moreover, if the spacing is made too small, this may result in a risk of a breakdown, in particular when the resonators are used in power applications, such as in transmitter filters of radio apparatus, because the maximum of the electric field of the resonator is, as is a well known fact, in the tip of the rod or of the helical coil. One more weakness found in this method is that the risk of breakdown increases when said space is reduced. A risk of breakdown and rapid deterioration of the Q value create an obstacle in aiming at complete compensation so that the compensation is under compensation in nature.

A second way known in the art is to place a bimetal strip on the tip of the rod resonator so that it is parallel to the top surface of the cover. As the temperature rises the strip bends off from the cover, thus reducing the loading capacitance according to the temperature. One of the drawbacks of said method is, just as in the first method, that the bimetal strip lowers the Q value of the resonator and that the bimetal is very difficult to work with. The bimetal strip may also be placed on the cover of the housing, though this is not a good place for it in that the temperature of the cover is much lower than the temperature of the tip of the compensator, whereby the bimetal will not conform to the temperature it should.

A third method is to select the materials so that the temperature changes very little affect the dimensions thereof. The selection concerns, above all, the material of the rod, for which is selected e.g. coated iron with a lower temperature coefficient than in the copper rod usually employed. In that case, a drawback is an increase of weight in a filter constructed from resonators.

European Patent Application No. 0,211,455 discloses a microwave cavity with a conical base plate (3) which is designed to move in responses to changes in ambient temperature such that the volume enclosed by the conical base varies in inverse proportion to temperature i.e. the higher the temperature the smaller the volume. This teaching is the opposite of that of the present invention in which the volume within the cover increases with increasing temperature.

International Patent Application No. 87/03745 discloses a microwave resonator having a cavity which comprises a temperature compensating member 26 the dimensions of which are such that it will increasingly bow into the cavity volume with increasing temperature which is the opposite teaching to that of the present invention.

U.S. Pat. No. 3,740,677 and 4,156,860 both disclose microwave cavities having movable temperature compensating discs similar to that disclosed in European Patent Application No. 0,11,455, U.S. Pat. No. 3,873,949 discloses a cavity resonator having a hollow cupshaped compensation member secured in a wall of the cavity. However, this specification does not disclose the form of compensation plate or the means of attachment thereof to the cavity wall as disclosed in the present invention.

SUMMARY OF THE INVENTION

According to the present invention there is provided a temperature compensated radio frequency resonator, comprising, an electrically conducting provided with a side surface (2) and a top surface (4), an inner conductor (3) inside the cover, with one end electrically coupled to the cover and the other end spaced from the top surface (4), characterized in that inside the housing is provided a compensation plate (5), the centre part (12) of which is spaced from the top surface (4) and which is attached at least at two opposite edge parts (8, 9) to the top surface (4), the coefficient thermal expansion of the compensation plate (5) being less than the coefficient of thermal expansion of the top surface, whereby in response to a rise in temperature, the centre part (12) of the compensation plate (5) is urged towards the top surface (4).

An advantage of the present invention is the provision of such resonator temperature compensation with which an over compensation, under compensation and precision compensation can be provided and which has none of the drawbacks of the above applications known in the art.

A second advantage is the provision of temperature compensation which is appropriate both for helical and rod resonators and filters constructed therefrom and which can easily and advantageously be applicable for industrial production.

BRIEF DESCRIPTION OF THE DRAWINGS

An embodiment of the invention is described below in detail, by way of example, with reference to the accompanying drawings in which.

DETAILED DESCRIPTION OF THE INVENTION

Figure 1:
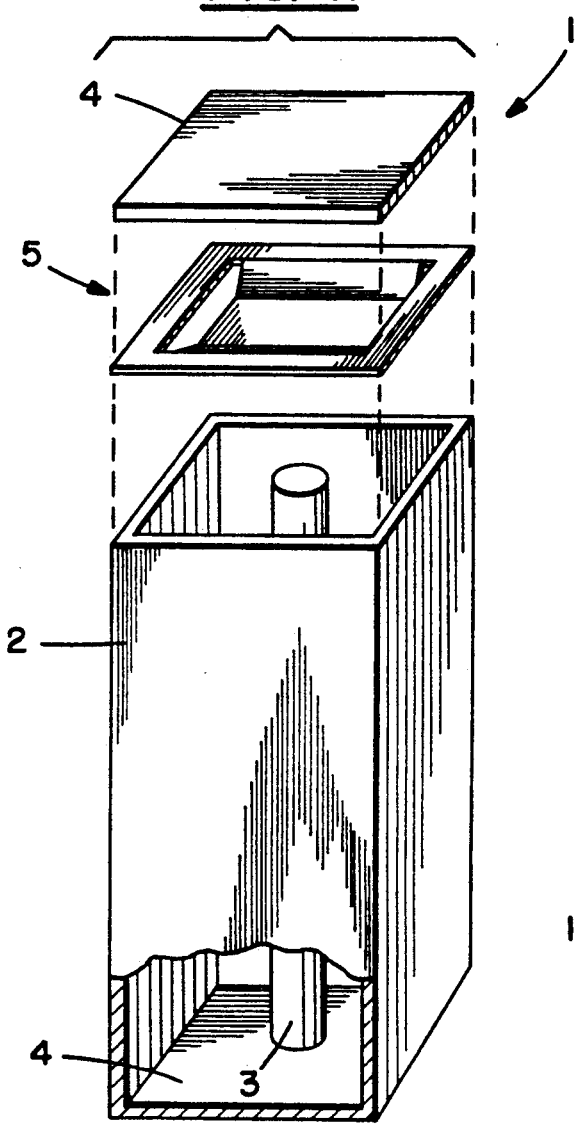
FIG. 1 shows an assembly view of a resonator in which the temperature compensation in accordance with the invention is used.

FIG. 1 presents a rod resonator structure 1 which in a manner known in the art comprises a resonator rod 3 and a cover 2 axially encircling it. End surfaces 4 and 4' are attached to the cover 2. The rod 3 is at one end attached to the end surface 4' which could be called the bottom surface. The other, free end of the rod is at a given space (FIG. 4) from the top surface 4 which could be called the cover. This kind of basic design is in itself conventional and may vary. The connections for coupling signal input and output to and from the resonator are for the sake of clarity omitted. The cover 2 may be round or also rectangular in cross-section, as well as comprise a number of resonator rods. The housing is usually made of aluminium and coated inside e.g. with silver, and the rod is a copper rod, equally coated on the outer surface. The distance of the tip of the rod 3 from the surface 4 (distance a+b in FIG. 4) determines, as is known in the art, the loading capacitance of the resonator when the plate 5 is not used. When the resonator is in use as part of an electric circuit such as filter, the rod 3 becomes hot and, as a result thereof expands and, becomes longer, whereby the resonance frequency decreases. This can be prevented by using a compensation plate 5 of the invention between the top surface 4 of the cover 2 and the resonator rod 3.

Figure 2:
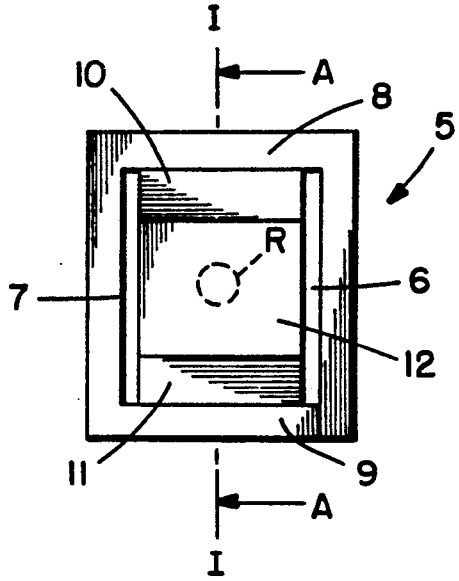
FIG. 2 shows a top view of the compensation plate of FIG. 1.
Figure 3:
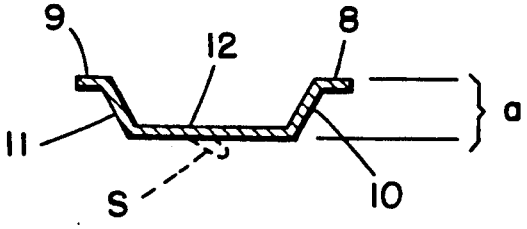
FIG. 3 shows a cross-sectional view of the compensation plate of FIG. 2.

The compensation plate 5 is a plate made from a thin metal sheet for example by die stamping and bending, its outer dimensions corresponding to the shape of the top surface 4, as is shown in FIG. 1. The temperature coefficient of the plate is smaller than that of the top surface 4, whereby, when the cover is made of aluminium, the plate material is preferably copper. The compensation plate 5 is not totally planar but a surface 12 has been formed thereon, by bending, which is substantially parallel with the surface of the edge parts 8, 9 of the plate, FIG. 3. This can be produced, as in FIG. 2, in that grooves 6, 7 in parallel with the sides are die stamped in a plate-like blank, adjacent to the opposite edges thereof. Thereafter, bendings are made in the plate part between the grooves so that a profile like the one shown in FIG. 3 is produced, said profile being provided with edge faces 8, 9, slanted side faces 10,11 limited thereto, and a straight bottom surface 12 which is at a distance "a" from the edge faces of the plate. A surface of another shape of a depth "a" can be made in the compensation plate, but in that case one has to observe that the stresses produced along with the heating of the plate should not cause unmanageable deformations in the plate.

Figure 4:
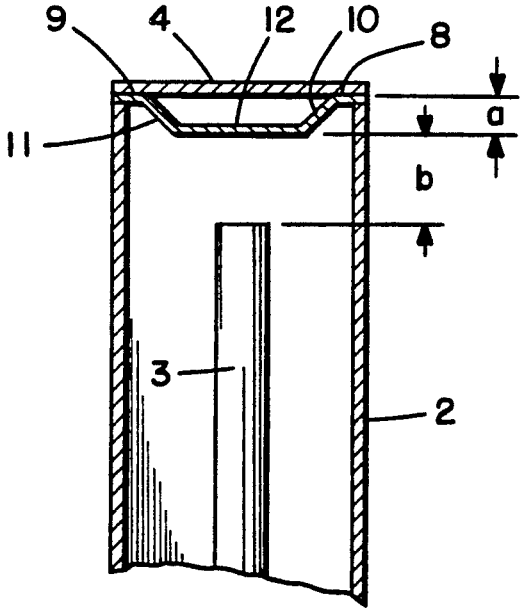
FIG. 4 shows a partial section of the resonator of FIG. 1 with the compensation plate attached.

After the compensation plate 5 has been produced, it is placed in the manner shown in FIG. 1 under the top surface plate 4 of the resonator 1, whereby the assembled structure is as the one shown in FIG. 4. The distance of the surface 12 of the compensation plate 5 from the surface 4 of the resonator cover is "a" and the distance of the resonator rod tip from the surface 12 is "b". This distance "b" greatly defines the capacitative loading of the resonator. When in a filter application, for instance in a transmittance filter, the filter becomes hot, it results in a lengthening of the rod 3. Because of the heating, also the housing 2 becomes lengthened in the direction of the rod, and the distance a+b increases, i.e. the capacitative loading (unless the compensation plate 5 is used) decreases. This is not, however, enough in order to compensate a change in the resonance frequency but a complete compensation is achieved with the aid of the plate 5. When the surface 4 expands owing to the effect of heat, this causes that it as if tries to "straighten" the compensation plate attached thereto in which the temperature coefficient is smaller than that in the surface 4. The distance a diminishes now as the temperature rises and the even part 12 of the compensation plate 5 "escapes" in front of the tip of the rod 3. By means of correct dimensioning a situation can be provided that the distance b and there through the loading capacitance of the resonator decreases along with temperature increase completely controllably so that the resonance frequency remains unchanged when the temperature changes. By means of the dimensioning, over compensation is easy to arrange so that the frequency of the resonator increases as desired together with temperature rise. This is preferred in some instances because in a case in which the filter comprises a number of resonators, the range of lower attenuation in the upper end of the attenuation curve is entered, whereby the transmittance attenuation is lower, the temperature of the resonator drops and therethrough, also the frequency goes down. In some instances it is preferable to use under compensation, whereby along with the temperature rise the frequency goes down at the desired speed.

A plate like piece of a conducting material is positioned between the open end of the resonator rod and the top surface of the resonator cover opposite thereto, the centre part in which being even and aligned therewith, and at a space therefrom. The opposite edge parts of the piece have been bent and attached to the cover electrically and mechanically reliably. It is essential that the temperature coefficient of the plate-like body is lower than the temperature coefficient of that surface of the cover whereto it is attached. Copper is appropriate for the material in the case that the material of the cover is aluminium. The plate-like body serves as a compensation plate which because of the lower thermal expansion than its affixing base increases a change in the space between open end of the resonator rod and the compensation plate opposite thereto and thus changes the loading capacitance of the resonator according to temperature. By shaping the compensation plate, with the temperature coefficient and selection of the distance from the tip of the resonator rod, either under compensation, over compensation or precision compensation can be produced. By selecting said features in an appropriate manner, the compensation can be arranged to be such that the filter while getting hot "creeps", i.e. moves in the direction in which its transmittance attenuation is smaller. The loss heat produced by the filter reduces in that case and a risk of the filter or its resonator being damaged becomes smaller.

A preferred embodiment of the invention is described above. While remaining within the protective scope of the invention, the invention can be implemented in a number of different ways. It can be used, not only for compensating coaxial and helical resonators, but also for compensation of the cavity resonator and, in principle, also of a ceramic resonator. By placing a compensation plate on one wall of the cavity resonator, the volume of the cavity and there through also the resonance frequency can be changed controllably according to the temperature. The shape of the compensation plate is in no way limited, what is essential is that its temperature coefficient is smaller than that of the part of the resonator structure whereto the plate has been attached. The use of the compensation plate also enhances the Q value of the resonator in two ways: first, its electrical conductivity is better than that of the actual housing material (e.g. copper versus aluminium), and the electrical conductivity can easily be added by coating the compensation plate e.g. with silver, and to coat the housing and particularly its cover with a less expensive and a poorer material such as tin. Secondly, in coaxial and helical resonators, the distance between the rod tip and the conducting surface opposite thereto (in the starting situation) can be made larger than that which is possible without a compensation plate. The loading capacitance is therefore smaller and the Q value of the resonator is higher. An adjusting part is easy to place in the compensation plate, for instance a tongue S, shown in broken line in FIG. 3, by bending which the resonance frequency can be tuned to be appropriate. A hole may also be made in the plate, as e.g. a hole R depicted in broken line in FIG. 2, through which hole the known adjusting screw or other adjusting component (not shown) attached to the top surface 4 and intended for tuning the resonance frequency passes.

In view of the foregoing it will be clear to a person skilled in the art that modifications may be incorporated without departing from the scope of the present invention.

We claim:

1. A temperature compensated radio frequency resonator, comprising:

an electrically conducting housing provided with a side surface, a bottom surface and a top surface;

a conductive post inside the housing and having one end electrically connected to the bottom surface and another end spaced from the top surface;

a compensation plate within said housing and having a center part spaced from the top surface, said center part rigidly attached to at least at two opposite edge parts which are attached to said top surface, said compensation plate having a coefficient of thermal expansion that is less than a coefficient of thermal expansion of the top surface, whereby in response to a rise in temperature, the center part of the compensation plate is urged towards the top surface so as to counter capacitive change effects occurring as a result of said rise in temperature.

2. A resonator as claimed in claim 1, wherein the rigid attachment of the center part and each of said edge parts are via connecting parts that are obliquely angled relative to the center part.

3. A resonator as claimed in claim 2, wherein the compensation plate is a one-piece plate and said center and connecting parts are joined at bends in said compensation plate.

4. A resonator as claimed in claim 1, wherein the center part of said compensation plate comprises a flat face opposite the top surface, said center part coated with an electrically conducting material.

5. A resonator as claimed in claim 1, wherein the top surface of the housing is made of aluminum and the compensation plate is made of copper.

6. A resonator as claimed in claim 1, wherein the center part of the compensation plate includes a hole for receiving a means for tuning the radio frequency resonator.

7. A resonator as claimed in claim 1, wherein a tongue projects from the center part to enable a tuning of the resonant frequency of the resonator.

* * * * *